United States Patent [19]

Cole

[11] Patent Number: 4,991,689

[45] Date of Patent: Feb. 12, 1991

[54] SAFETY RESTRAINT DEVICE

[75] Inventor: Barry A. Cole, Colchester, Conn.

[73] Assignee: SINCO, Inc., East Hampton, Conn.

[21] Appl. No.: 522,253

[22] Filed: May 11, 1990

Related U.S. Application Data

[63] Continuation-in-part of Ser. No. 389,752, Aug. 4, 1989, Pat. No. 4,923,048.

[51] Int. Cl.[5] ..... A62B 35/00

[52] U.S. Cl. ..... 182/3

[58] Field of Search ..... 182/3, 4, 5, 6, 7, 8, 182/9

[56] References Cited

U.S. PATENT DOCUMENTS

| | | | |
|---|---|---|---|
| 548,076 | 10/1895 | Mack | 182/9 |
| 1,504,030 | 8/1924 | Dettwiler | 182/9 |
| 1,721,516 | 7/1929 | Jacobs | 182/9 |
| 1,802,288 | 4/1931 | Strauss | 182/9 |
| 4,923,048 | 5/1990 | Cole | 182/9 |

*Primary Examiner*—Reinaldo P. Machado

*Attorney, Agent, or Firm*—Chilton, Alix & Van Kirk

[57] ABSTRACT

A safety restraint device, such as worn by a worker for preventing falls, employs a sliding ring which is mounted to the safety lanyard. The releasable snap hook of the safety lanyard may be engaged in the sliding ring to secure the safety lanyard to a fixed object.

12 Claims, 3 Drawing Sheets

SAFETY RESTRAINT DEVICE

CROSS-REFERENCE TO RELATED APPLICATION

This application is a continuation-in-part of U.S. application Ser. No. 389,752 filed on Aug. 4, 1989 now U.S. Pat. No. 4,923,048.

BACKGROUND OF THE INVENTION

This invention relates generally to body belts, harnesses, and the like which are worn by workers to prevent falls. More particularly, the present invention relates to safety devices having one or more lanyards which connect or tie off with a fixed object.

In hazardous occupations and work conditions, body belts and body harnesses have long been employed by workers to reduce the potential for serious falls. Such body belts and body harnesses come in a wide variety of styles, types and configurations. Conventionally, a safety belt is secured around the waist of the worker. A lanyard connects to the safety belt for securement around a fixed object. A number of conventional body belts to which the invention relates employ generally D-shaped pivotal ring members which are connected to the belt wrapped around the worker's waist. The lanyard is then connected between the pivotal D-ring members. Releasable snap hooks, which employ a releasable keeper securable in a locked position, are attached at the ends of the lanyard and are engagable with the D-ring member for connecting the lanyard back into the body belt.

Despite a number of designed safety features of conventional body belts, the connection of the lanyard to the body belt is not always feasible or desirable. Connecting to other than a D-ring may present a potential for accidental disengagement. Connecting more than one snap hook to a single D-ring is undesirable because a binding condition may occur which allows pressure to be applied to the safety mechanism causing accidental roll out. Under certain unusual and intense load conditions, it is possible that conventional lanyards connected to other than a D-ring may encounter a "roll-out" condition due to the positioning of the lanyard line over the snap hook safety mechanism or may result in binding or damaging the lanyard and/or safety mechanism. While "roll-out" conditions are quite infrequent and can be prevented by the worker observing certain safety precautions, the consequences of an actual "roll-out" condition are potentially life threatening.

SUMMARY OF THE INVENTION

Briefly stated, the invention, in a preferred form, is a safety restraint device which employs a safety belt for attachment around the waist of an individual or a body harness. A safety lanyard connects with a pivotal ring mounted to the safety belt or body harness. The safety lanyard includes a flexible cable, rope or webbing material for attachment to a fixed object. A snap hook, including a releasable safety keeper, is attached at the end of the cable for securing the lanyard. A sliding ring is mounted to the lanyard for slidable positioning along the cable. The ring comprises a connector sleeve which defines a longitudinal channel dimensioned for slidably receiving the lanyard. A generally D-shaped ring extends from the connector sleeve. The ring is dimensioned so that the hook may be attached to the D-ring with the likelihood of roll out being minimized. The lanyard is wrappable around the fixed secure object and the hook is engagable with the sliding D-ring to secure the lanyard to the fixed object.

The connector sleeve includes enlarged tapered end portions so that the ends of the connector sleeve do not overly strain the lanyard during a fall or other loading conditions. The channel wall portions of the sleeve are also finished to alleviate undue abrasion between the lanyard and the connector sleeve.

An object of the invention is to provide a new and improved safety restraint device.

Another object of the invention is to provide a new and improved mechanism for securing a safety restraint device lanyard around a fixed object.

A further object of the invention is to provide a new and improved safety restraint device which prevents "roll-out" of the connector hook of the lanyard.

A yet further object of the invention is to provide a new and improved safety restraint device having an extended range of "tie off" positions and allowing for increased worker mobility by reducing the need to have the lanyard connected back to the belt or harness mounted D-ring.

Other objects and advantages of the invention will become apparent from the drawings and the specification.

DETAILED DESCRIPTION OF THE INVENTION

Figure 1:
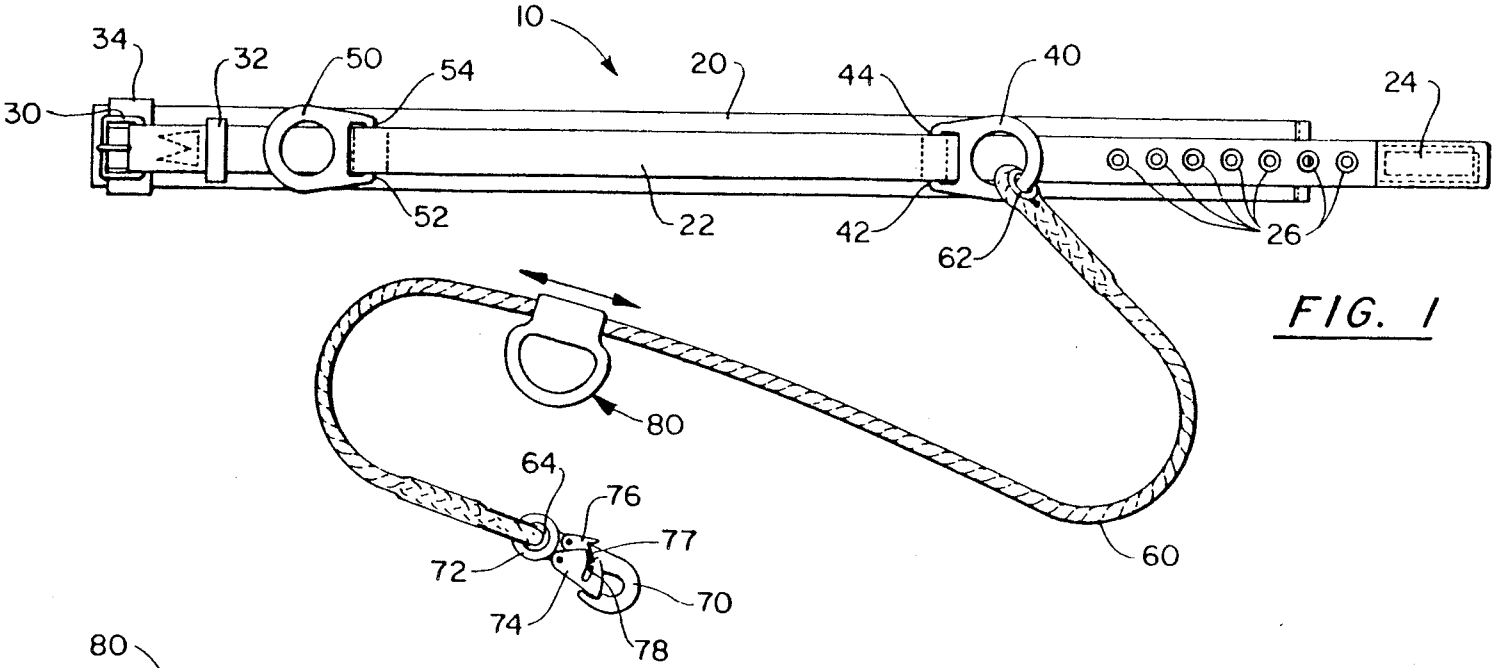
FIG. 1 is a side view of an elongated unsecured configuration of a safety restraint device in accordance with the present invention.

With reference to the drawings wherein like numerals represent like parts throughout the figures, a safety restraint device incorporating the improvement of the present invention is designated generally by the numeral 10. Safety restraint device 10 comprises a belt 20 which is secured around the waist of an individual. The safety device is connected and/or tied off to a fixed object 100 (schematically illustrated) to prevent the wearer from accidentally falling or to greatly limit any free fall should the wearer accidentally slip. The invention has applicability in connection with a wide variety of safety body belts, harnesses, and the like. It should be appreciated that the specific body belt 10 of FIG. 1 is illustrated for purposes of describing the invention and is not a limitation of the applicability or the scope of the improvement of the present invention.

Safety belt 12 includes a rugged reinforced inner belt 20 which is formed of heavy-duty woven, multi-ply webbing material. An outer narrower webbing strip 22 connects with the inner belt and extends circumferentially therewith in overlapping relationship. The outer strip 22 is securely stitched to the inner webbing of the inner belt 20 along the back portion thereof. A leather lining 24 is stitched at the inner surface of the outer webbing strip 22 and wrapped around one end portion thereof and stitched in place. A co-linear series of openings 26 extend through the outer webbing strip 22 and the leather lining 24. Brass rivets may be stamped into the openings. The opposing end of the webbing strip 22 secures a belt buckle 30 of heavy-duty form which is engagable in a selected opening 26. A belt loop 32 is also secured by the outer webbing. A forward interiorly projecting leather loop 34 is dimensioned to receive the inner belt 20 so that the inner belt extends therethrough and the webbing strip may be buckled in a conventional manner.

A pair of heavy-duty metal D-shaped ring members 40 and 50 are mounted for pivotal positioning at spaced positions along the body belt. The D-ring members include respective connector shafts 42 and 52 which extend in generally perpendicular relationship to the longitudinal axis of the body belt. Cylindrical wear pads 44 and 54 are wrapped around the shafts. The webbing strip 22 is secured to the inner belt 20 to form loops which connect the D-rings to the body belt.

A safety lanyard 60, which may be either a steel cable or a member having a fibrous rope-like composition, is wrapped around D-ring member 40 and spliced in place. Alternately, the lanyard could be hooked to D-ring member 40. A thimble 62 is preferably interposed around the D-ring member at the inside of the splice loop for preventing excessive abrasion which would tend to fray or weaken the fibers or wires. It should be appreciated that the D-ring members 40 and 50 are freely pivotal and have an orientation which is perpendicular to the longitudinal axis of the safety belt.

The free end of the lanyard 60 connects with a hook 70 through a ring 72. The lanyard is spliced around a thimble 64 which loops the ring 72. The thimble 64 also functions to prevent excessive abrasion of the metal ring against the lanyard cable. A spring-loaded keeper 74 is biased to enclose the eye of the hook. A release lever 76 is also mounted to the hook. The release lever 76 includes a projecting tab 77 which interferes with the keeper to prevent release of the keeper. The lever is manually depressable so that the tab 77 passes through a slot 78 of the keeper for releasing the keeper from the safety closed position. The hook 70 may be engaged either by opening the hood manually or by forcing the D-ring member 50 into the eye of the hook against the bias of the keeper. The keeper then biases to the closed position and the release latch is biased to pivot to prevent release of the keeper.

Figure 3:
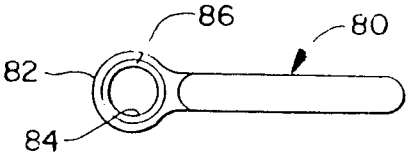
FIG. 3 is a top plan view of the D-ring connector of FIG. 2.
Figure 2:
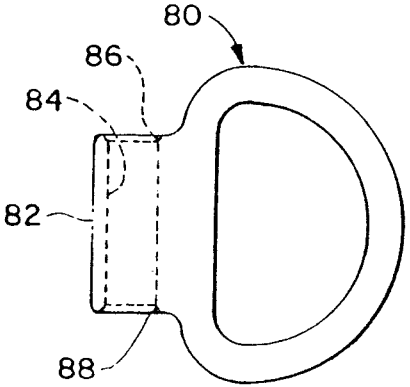
FIG. 2 is an enlarged side elevational view, partly in phantom, of a sliding D-ring connector employed in the safety restraint device of FIG. 1.
Figure 4:
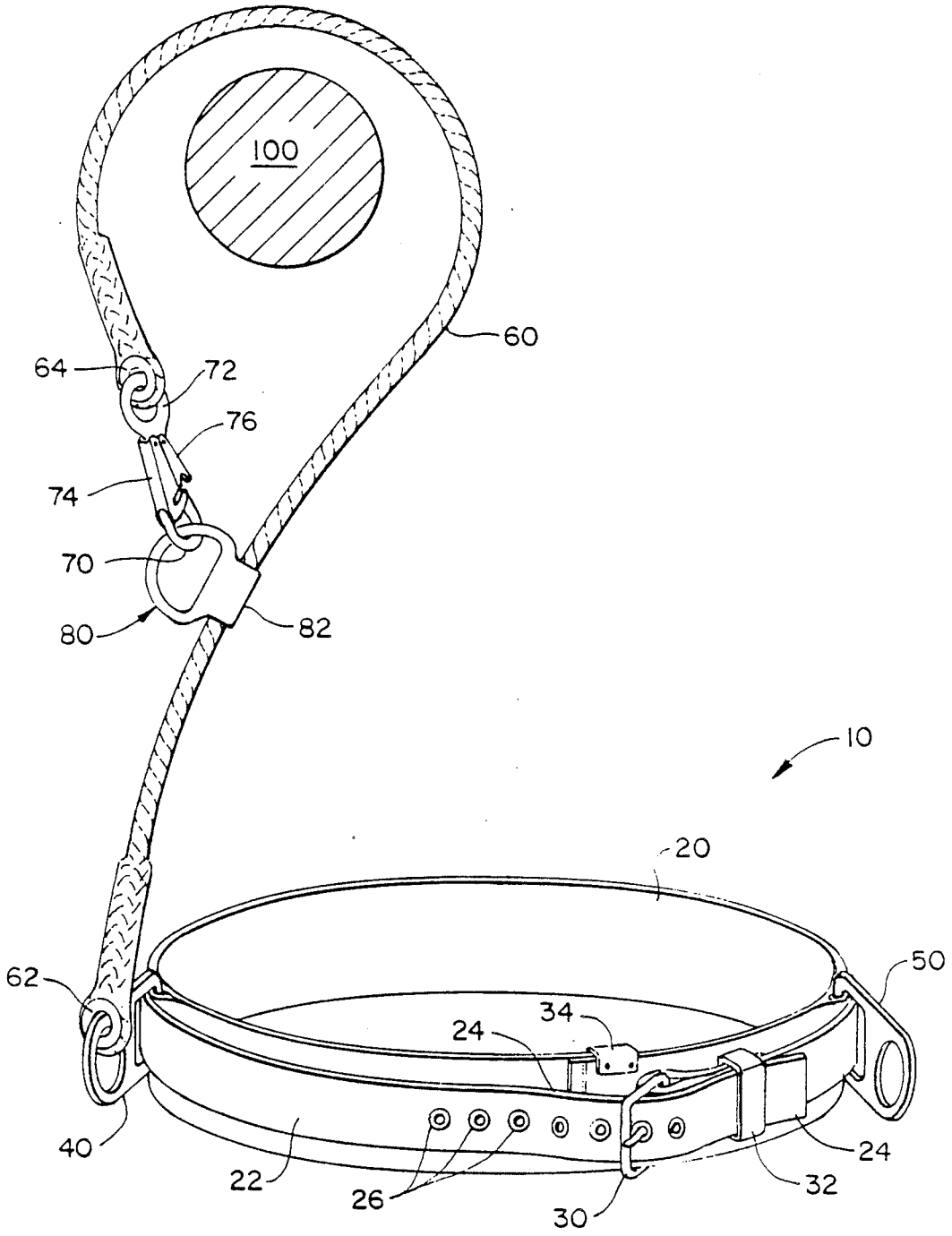
FIG. 4 is a perspective view of the safety restraint device of FIG. 1 illustrated in a selected operable mode.

With additional reference to FIGS. 3 and 4, a sliding generally D-shaped ring 80 includes an integral connector sleeve 82 which defines a longitudinal channel 84. The D-ring is made of a rugged metal material such as steel in accordance with existing standards. The end portions of the channel have flared tapered openings 86 and 88. The channel is generally uniformly dimensioned so that the lanyard may be slidably extended therethrough for mounting the D-ring 80 to the lanyard 60. The flared openings 86 and 88 prevent fraying of the lanyard and excessive abrasive forces against the lanyard. In addition, the inner portion of the channel has a smooth finish to allow it to be freely slidable to prevent undue frictional abrasion against the lanyard.

The sliding D-ring 80 is dimensioned so that the hook 70 is engagable therewith and the keeper 74 locks the hook to the sliding D-ring. In one mode of the invention, the safety restraint device is mounted to the wearer by securing the safety belt 12 in place. With reference to FIG. 4, the lanyard 60 is then wrapped around a fixed object 100 (which ordinarily should be capable of supporting a dead weight of 5,400 pounds) and is secured back to the lanyard through the sliding D-ring 80. The sliding D-ring functions in a fashion which prevents the "roll-out" condition where the lanyard cable engages the snap hook as may occur under certain unusual conditions with the conventional tying back of the lanyard to D-ring member 50 or other connection point.

The lanyard cable is preferably relatively short, such as on the order of a few feet, so that should a wearer accidentally fall, the free fall will be limited. For some applications, it may not be possible to connect the hook 70 with the sliding D-ring 80. In the latter case, the hook ideally should be connected in a conventional fashion to a fixed pivotal D-ring member 50. The sliding D-ring 80 is then simply left in a free condition. It should be appreciated that the sliding D-ring 80 and the hook 70 are configured so that the safety snap hook does not disengage without manual release and disengagement. The lanyard may also be configured to have a hook 70 on both ends with one hook connecting D-ring member 40.

Figure 5:
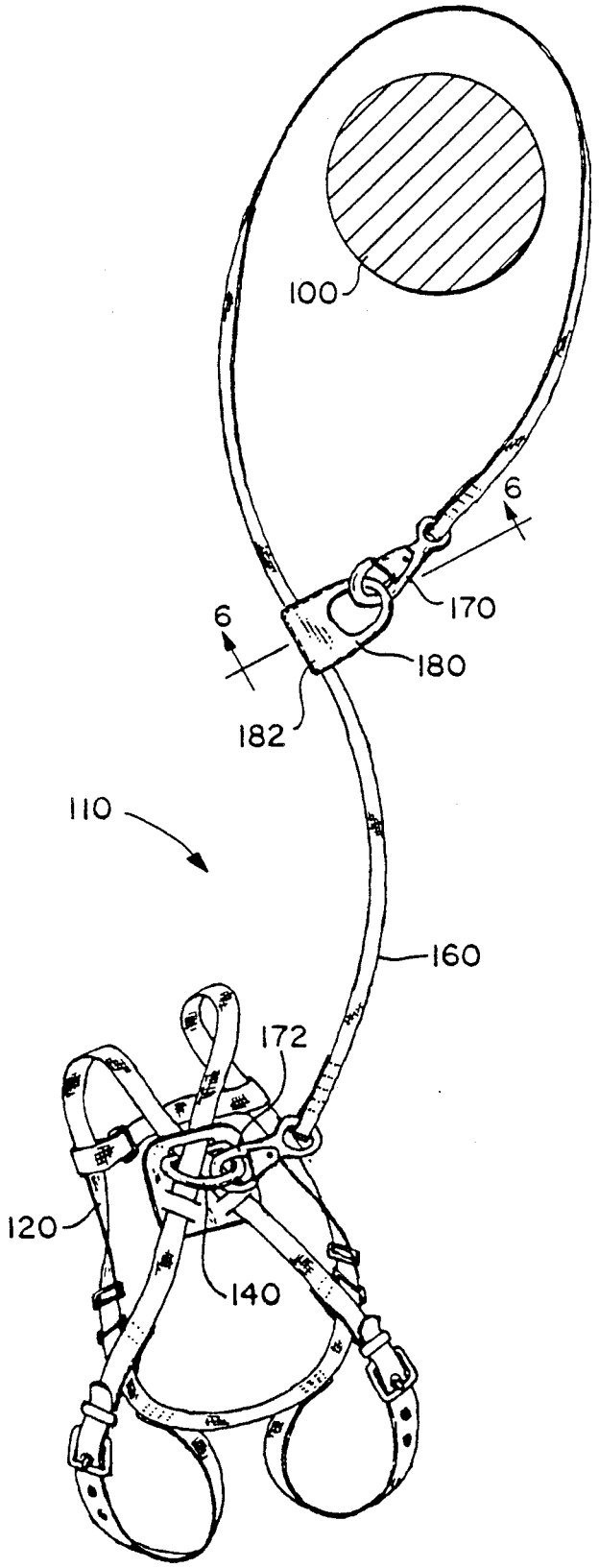
FIG. 5 is a perspective view of a second embodiment of a safety restraint device in accordance with the present invention.
Figure 6:
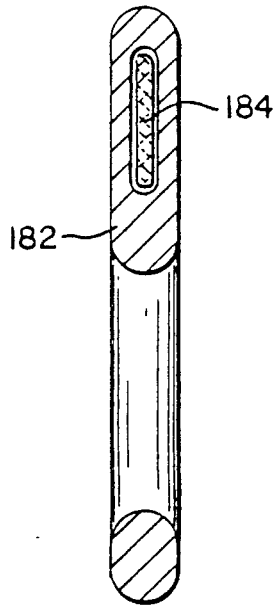
FIG. 6 is a sectional view of the sliding connector of the device of FIG. 5 taken along the line 6—6 thereof.

With reference to FIGS. 5 and 6, a second embodiment of a safety restraint device incorporating the improvement of the present invention is generally designated by the numeral 110. Safety restraint device 110 comprises a body harness 120 which may be secured to the body of an individual. The safety device may be connected and/or tied off to a fixed object 100 as previously described for safety device 10.

Excepting for the improvements described herein, harness 120 may be of conventional form and function. The harness includes at least one heavy duty metal D-ring member 140. A safety lanyard 160 has a web-like composition and a strap-like configuration. The lanyard 160 terminates at opposing ends in a pair of snap hooks 170 and 172 which are mounted to the lanyard by looping the end portion of the lanyard through the hook and stitching the overlapping end portion. The hook 170 and 172 include spring loaded keepers which are biased to enclose the eye of the hook.

A sliding generally D-shaped ring 180 includes an intregal connector sleeve 182 which defines a longitudinal channel 184. The D-ring 180 is made of a rugged metal material such as steel. The channel has a generally rectangular shaped cross section with contoured corners (as best illustrated in FIG. 6) which generally conforms to the corresponding sectional dimensions of the lanyard and is slightly greater than the corresponding dimensions of the lanyard to provide a sliding type movement of the ring 180 relative to the lanyard. A pair of flared openings 186 and 188 prevent the lanyard from fraying and also prevent excessive abrasive forces from being exerted against the webbed lanyard. Likewise, the inner portion of the channel preferably has a smooth finish to prevent undue frictional abrasion against the lanyard. It should be appreciated that the inner shape of the sliding ring may be more of an 0-shape rather than the D-shape illustrated in the drawings. The sliding D-ring 180 is dimensioned so that the hook 170 is engageable therewith and the keeper locks the hook to the sliding D-ring. The ring functions in a similar fashion to that described for D-ring 80 and safety restraint device 10 so as to prevent the rollout condition wherein the lanyard engages the snap hook as may occur under the conditions previously discussed.

While a preferred embodiment of the invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety restraint device comprising:
harness means for attachment to an individual;
safety lanyard means connected to said harness means for attachment to a fixed object, said lanyard means comprising:
a lanyard having a free end;
snap hook means connected to said lanyard at said free end comprising a hook having a releasable safety keeper for securing said lanyard means;
slidable ring means mounted to said lanyard for slidable positioning therealong, said ring means comprising a connector sleeve defining a longitudinal channel for receiving said lanyard and a ring integrally extending from said connector sleeve and dimensioned wherein said hook may be securely attached to said slidable ring,
so that said lanyard is wrappable around a fixed object and said snap hook means is engagable with said slidable ring to secure said lanyard means to said fixed object.

2. The safety restraint device of claim 1 wherein said slidable ring has a substantially D-shape.

3. The safety restraint device of claim 1 wherein said connector sleeve further defines flared openings at the end portions of said channel.

4. The safety restraint device of claim 1 wherein said channel has a generally cylindrical configuration having a diameter which is slightly greater than the diameter of the lanyard.

5. The safety restraint device of claim 1 wherein said safety lanyard means is connected to said safety belt means by means of a second ring which is attached in a fixed orientation to said safety belt means for pivotal positioning thereabout and further comprising a third ring attached to said slidable belt means in a fixed orientation for pivotal relationship thereabout and wherein said snap hook means may be connected to said sliding ring.

6. A safety restraint device comprising:
harness means for attachment to the body of an individual comprising a harness and at least one ring attached to said harness;
safety lanyard means connected to a said harness ring for attachment to a fixed object, said lanyard means comprising:
a web-like lanyard connecting the said ring and having a free end;
latch hook means connected to said lanyard at said free end comprising a latch member for securing said lanyard means;
slidable ring means mounted to said lanyard for slidable positioning therealong, said ring means comprising a connector sleeve defining a longitudinal channel dimensioned to slidably receive said cable and an arcuate D-shaped ring integrally extending from said connector sleeve and dimensioned wherein said latch means may be securely attached to said slidable ring.

7. The safety restraint device of claim 6 wherein said connector sleeve further defines flared openings at the end portions of said channel.

8. The safety restraint device of claim 6 wherein said channel has a generally rectangular configuration with rounded corners, said channel having dimensions which are slightly greater than the corresponding dimensions of the lanyard.

9. A safety restraint device comprising:
safety belt means for attachment to an individual comprising a belt fastenable around the waist of the individual and at least one pivotally positionable ring attached to said belt;
safety lanyard means connected to a said ring for attachment to a fixed object, said lanyard means comprising:
a web-like lanyard connecting the said ring and having a free end;
snap hook means connected to said lanyard comprising a hook having a manually releasable safety keeper for securing said lanyard means;
ring means mounted to said lanyard, said ring means comprising a connector sleeve defining a longitudinal channel for receiving said lanyard and a ring section having an arcuate portion, said ring section integrally extending from said connector sleeve and dimensioned wherein said hook means may be securably attached to said ring section.

10. The safety restraint device of claim 9 wherein said connector sleeve further defines flared openings at the end portions of said channel.

11. The safety restraint device of claim 9 wherein said channel has a generally rectangular configuration having dimensions which are slightly greater than the corresponding dimensions of the lanyard.

12. The safety restraint device of claim 9 wherein said ring section has a generally D-shape.

* * * * *